US010087637B1

(12) United States Patent
Beauregard

(10) Patent No.: US 10,087,637 B1
(45) Date of Patent: Oct. 2, 2018

(54) CEILING AND WALL LINER JOINT AND SPLINE ATTACHMENT ASSEMBLY

(71) Applicant: Arcoplast, Inc., St. Peters, MO (US)

(72) Inventor: Ghislain Beauregard, St. Peters, MO (US)

(73) Assignee: Arcoplast, Inc., St. Peters, MO (US)

( * ) Notice: Subject to any disclaimer, the term of this patent is extended or adjusted under 35 U.S.C. 154(b) by 0 days.

(21) Appl. No.: 14/991,143

(22) Filed: Jan. 8, 2016

Related U.S. Application Data

(60) Provisional application No. 62/101,474, filed on Jan. 9, 2015.

(51) Int. Cl.
*E04F 13/076* (2006.01)
*E04F 13/08* (2006.01)

(52) U.S. Cl.
CPC ..... *E04F 13/076* (2013.01); *E04F 13/0803* (2013.01)

(58) Field of Classification Search
CPC ..... E04F 13/076; E04F 13/0803
See application file for complete search history.

(56) References Cited

U.S. PATENT DOCUMENTS 3,171,232 A * 3/1965 Gretter ..... E04D 3/3602 52/282.4
3,490,800 A * 1/1970 Wissler ..... E04B 2/56 52/586.1
4,437,542 A 3/1984 Yeager et al.
4,742,985 A * 5/1988 Mathis ..... E04G 9/06 249/153
5,363,620 A * 11/1994 Liu ..... E04F 13/0846 403/269
5,950,389 A 9/1999 Porter
5,970,671 A * 10/1999 Bifano ..... E04B 1/765 428/603
6,796,097 B2 9/2004 Fensel et al.
2007/0151172 A1* 7/2007 Turco ..... E04F 19/062 52/127.6

FOREIGN PATENT DOCUMENTS

WO 2012075169 6/2012

* cited by examiner

*Primary Examiner* — Patrick J Maestri
(74) *Attorney, Agent, or Firm* — Spencer Fane LLP

(57) ABSTRACT

A wall panel and spline joining system and method for use in barrier designs used in high containment facilities. A system for joining the panels includes a spline connector designed to ensure planar alignment of the panel surfaces. Panel edges are provided with kerf grooves for receiving the spline connector. A sealing agent is placed within the kerf for bonding the spline connector to the panel. The spline connector is configured with flange elements having channels which permit the sealing agent to be distributed in and through the channels to enhance the bonding between the spline and the panels.

7 Claims, 6 Drawing Sheets

CEILING AND WALL LINER JOINT AND SPLINE ATTACHMENT ASSEMBLY

RELATED APPLICATION

The present non-provisional patent application claims priority benefit of an earlier-filed provisional patent application of the same title, Ser. No. 62/101,474, filed Jan. 9, 2015. The identified earlier-filed application is hereby incorporated by reference into the present application.

FIELD OF THE INVENTION

The present invention relates to wall and ceiling panel systems. In particular, an embodiment of the wall and ceiling panel systems relates to barrier designs used in high containment facilities such as laboratories. More specifically, an embodiment relates to a joint and spline attachment assembly for the wall and ceiling panel system.

BACKGROUND OF THE INVENTION

The biosafety industry strives to develop standards and facilities that provide mechanisms and practices to lower the risk of unintentional infection from pathogens or biological materials in the laboratory or environmental release of those materials from the laboratory. The Centers for Disease Control and Prevention (CDC) and the National Institutes of Health (NIH) have established levels of biosafety (BSL-1 to BSL-4) to guide laboratory researchers in the safe handling of biological agents. Generally, the term "high containment" refers to the higher levels of biosafety wherein enhanced protective measures are employed.

While all structural and operational aspects of a laboratory facility are considered in the overall approach in ensuring high containment protocol, the walls and ceilings of a facility are one of the most dynamic areas of laboratory design. Walls and ceilings provide the main barrier in preventing the escape of biological agents from a lab facility. There presently exist a number of barrier construction systems, including gypsum board panels, concrete blocks and stainless steel panels. Each system offers certain advantages but also suffer from disadvantages.

Another alternative in high containment barrier construction provides for a system of panels comprised of a homogeneous fiberglass reinforced resin core. This system provides a number of advantages over other systems. The homogeneity of the panel's core provides manufacturing advantages because problems faced in bonding different layers during the molding process can be avoided. The homogeneity of the core also ensures long-term impermeability which could otherwise be adversely affected by delamination of layers or damage to the surface of the panel. The solid core nature of the panel further confers a greater rigidity to the panel to contribute to the overall stability of the barrier structure. Also, by omitting a heavy internal core material, the panel is made lighter in weight while maintaining its strength and rigidity.

The homogeneous fiberglass reinforced resin core high containment barrier system provides for economies on the manufacturing and installation process. Because the homogeneous core does not require an interior substrate material sandwiched by the fiberglass reinforced resin material, the molding process for producing the panels need not be dictated by dimensional requirements of a substrate core material. This avoids potential waste as substrate core materials, such as cement board, comes supplied in standard sheet sizes whose dimensions may exceed the panel size requirements. Another advantage of the homogeneous core is that the panels may be manufactured within tight tolerances without disrupting the structural integrity of the panel. This permits a heightened degree of uniformity of joined panels when erecting the barrier system and creates a flat, even wall surface at areas where panels are joined together.

The panels can be used with traditional steel studs and furring channels, or attached to existing walls and ceilings. The panels present a viable option for retrofit applications as their substrate can be specified to fit the dimensions of an existing wall or ceiling system for a direct-fit replacement. One method of joining the homogeneous core panels employs a spline element that guides edges of the panels into alignment such that the inward facing surface of the erected wall or ceiling maintains an even surface and avoids an irregular surface at the seams where the panels are joined. The spline element helps guide the joined panels together in even alignment and provides a snug wedging fit to minimize play in the joint that may otherwise cause separation of the joined panels.

New and existing buildings are constantly threatened by building movement, building materials contracting under variable climate changes, laboratory's positive and negative pressure requirements and natural forces such as seismic and hurricane activities. As a primary barrier in high containment and research laboratories, it is critical that architectural interior finishes perform to required expectation. It is also equally paramount that the assembly methods and the products utilized to construct, bond and seal the panel joints can be constructed to deliver the highest level of integrity for the safety of its occupants and its surrounding environments. A primary barrier must function at the highest level so it can maintain a gas tight, air tight, water and moisture tight environment. These surfaces and panel joints must also withstand harsh decontamination and sanitizing protocols throughout the life cycle of the laboratory. It is therefore important to construct the primary barrier (room envelop) with high performance products and installation methods that require minimum components, with no exposed fasteners delivering a smooth, seamless finish resulting in an impenetrable barrier finish.

The reinforced fiberglass panel system provides for a kerf to be cut into the edge of the panels for receiving a spline element. A preferred spline element for joining the panels comprise a T-shaped section with dog elements, i.e., flanges, for insertion into the kerf edges of the panels. One method of joining the panels provides for inserting a liquid adhesive/sealant into the kerf prior to insertion of the dog elements of the spline. While providing enhanced bond strength of the spline element within the kerf, the relatively limited contact between the spline, adhesive and kerf may leave the panel joint susceptible to disruption caused by building movements associated with high impact, swings in positive and negative pressure changes, and potential seismic activities.

An embodiment of the present invention therefore provides an enhanced bond between the spline element and the panel edge kerf to yield a stronger panel joint.

BRIEF SUMMARY OF THE INVENTION

There is, therefore, provided in the practice of the invention a wall panel and spline joining system comprising panel members and spline connectors. The panel members comprise a homogeneous fiberglass reinforced resin core in which a kerf is disposed in the side edge of the panel. The spline connectors comprise flange elements configured to fit into the kerfs of the panel edges by which adjacent panel members may be joined in succession to form a wall surface. The flange elements are defined to have a wedge shape which help to both provide a snug fit between the panel and spline connector and to guide the adjacent panels into planar surface alignment. The flange elements are further provided with transverse channels which help promote thorough flow of sealing agent in the interstitial areas between the flange elements and the kerf side walls to enhance the bonding between the panels and spline connectors. The flange elements may also be provided with grooves running longitudinally along their surface that also receive a flow of sealing agent to further promote bonding.

In accordance with an embodiment of the invention, there is provided a wall panel and spline joining system.

In accordance with another embodiment of the invention, there is provided a method for joining panels in erecting a high containment enclosure.

In accordance with yet another embodiment of the invention, there is provided a spline connector for joining adjacent panel members.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention. Though some features of the invention may be claimed in dependency, each feature has merit when used independently.

BRIEF DESCRIPTION OF THE DRAWING FIGURES

The present invention is described herein with reference to the following drawing figures, with greater emphasis being placed on clarity rather than scale:

DETAILED DESCRIPTION OF THE INVENTION

Figure 1:
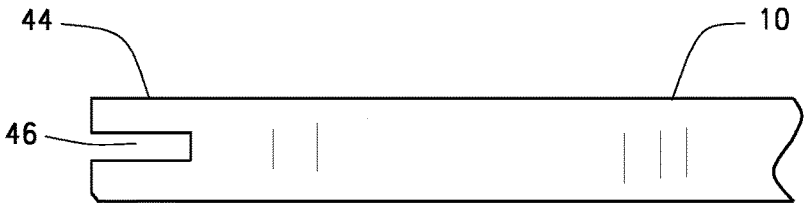
FIG. 1 shows a cross section of a homogeneous fiberglass reinforced resin core panel.
Figure 2:
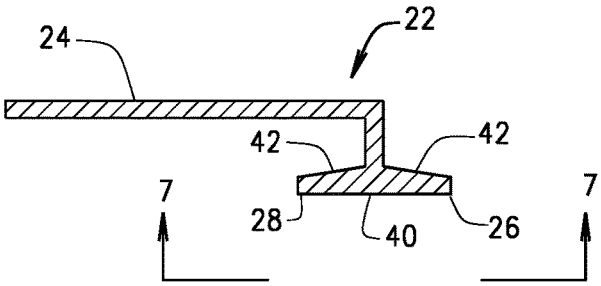
FIG. 2 is a cross sectional view of an embodiment of a spline element used for joining panels.
Figure 4:
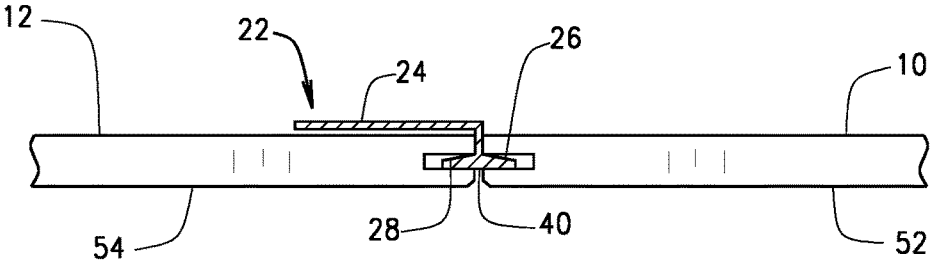
FIG. 4 is another cross-sectional view in side elevation of an embodiment of the spline joining system.
Figure 5:
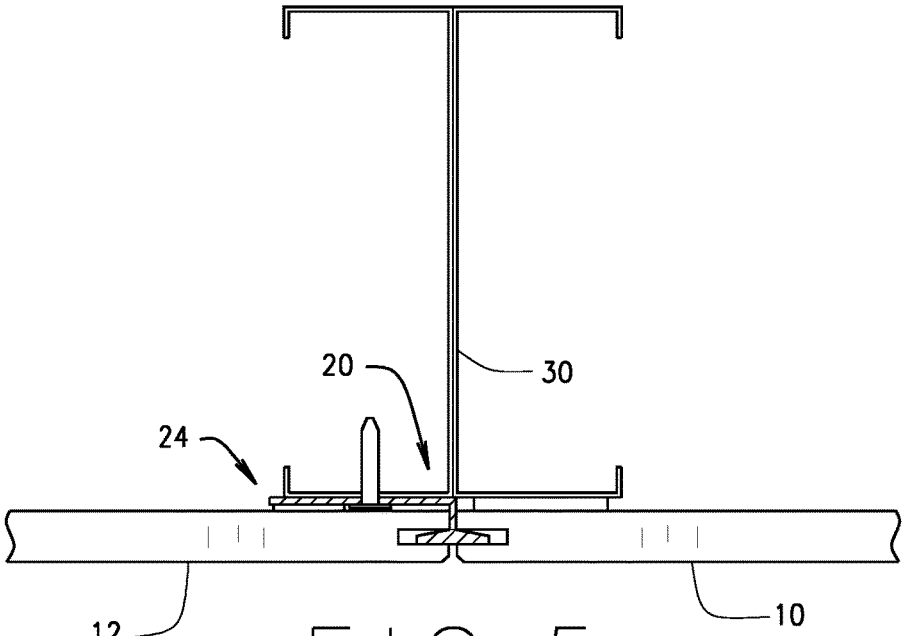
FIG. 5 is yet another cross-sectional view in side elevation of an embodiment of the spline joining system.
Figure 8:
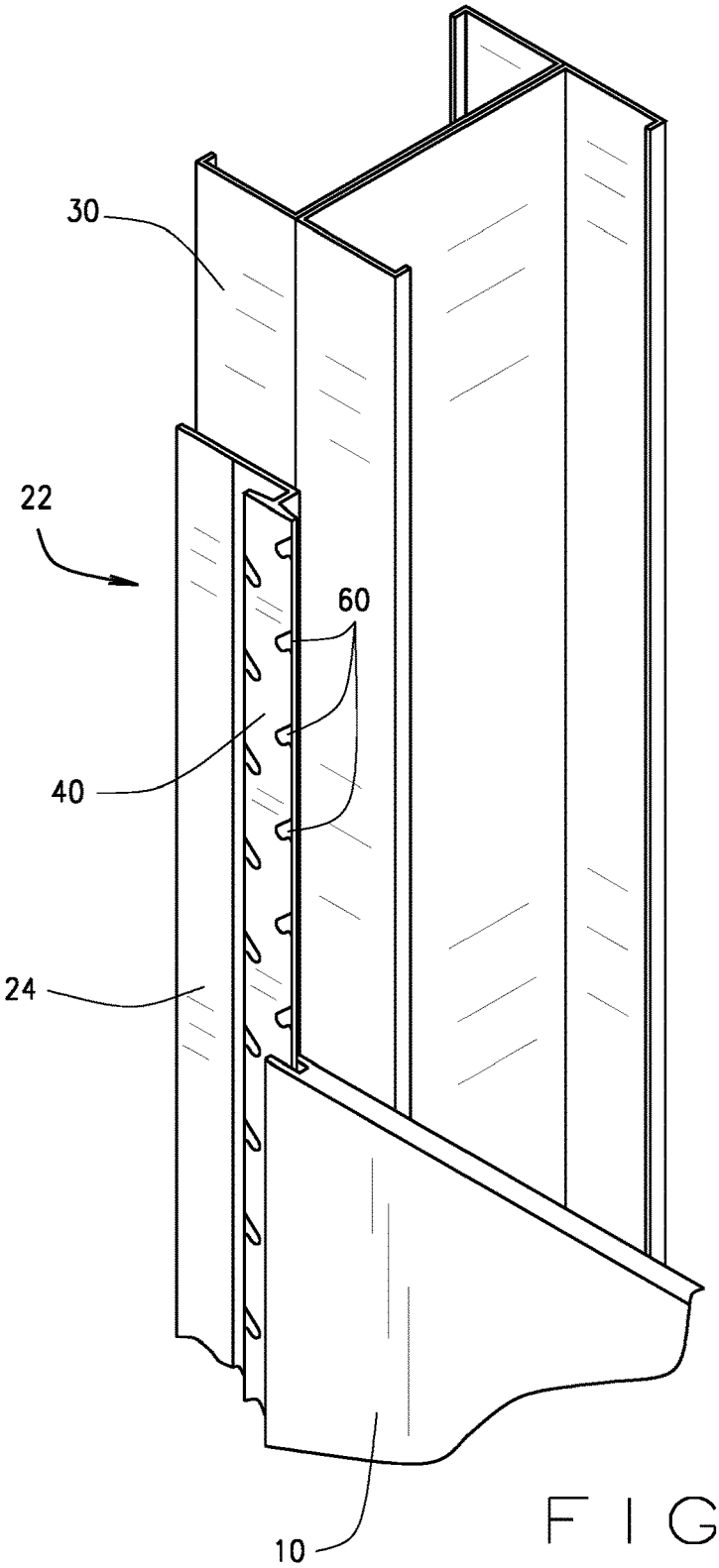
FIG. 8 is a perspective view of a wall panel engaging an embodiment of a spline element.

An embodiment of the present invention comprises a system for joining together panel edges of a homogeneous fiberglass reinforced resin core to create a continuous wall or ceiling surface of a high containment enclosure where the structural integrity of the panels at the joint area can be maintained while consistently placing the panel surfaces in a true plane. A panel 10 is formed of a solid core homogeneous fiberglass reinforced resin as shown in FIG. 1. Panel 10 is cut to an appropriate dimension as one of several panels that will collectively make up the wall or ceiling section. FIG. 5 generally shows the spline system 20 by which the panels are joined together and attached to the surface substrate. As shown in FIG. 5, the panels 10 and 12 may be secured to studs 30. Adjacent panels 10 and 12 are joined together at their edges by spline connector 22 as seen in FIGS. 3-6. Spline connector 22, which may be of aluminum, comprises an elongated leg 24 which is secured by screws or other appropriate fastener to stud 30 as shown in FIG. 5. The spline extends perpendicularly from elongated leg 24 to terminate in dog or flange elements 26 and 28 as shown in FIG. 2. Each of dog elements 26 and 28 extend laterally an equal distance and have a common distal flat surface 40. This flat surface runs longitudinally along the length of the spline connector 22 as shown in FIG. 8 and is positioned to run parallel with the panels to be joined. The spline may be constructed such that an interruption may be present in flat surface 40 between the respective dog elements. In any event, each dog element has one surface as being co-planar with the kerf side wall. Each dog element has an angled surface 42 opposing the flat surface 40 to give the dog element a wedge shape.

Figure 3:
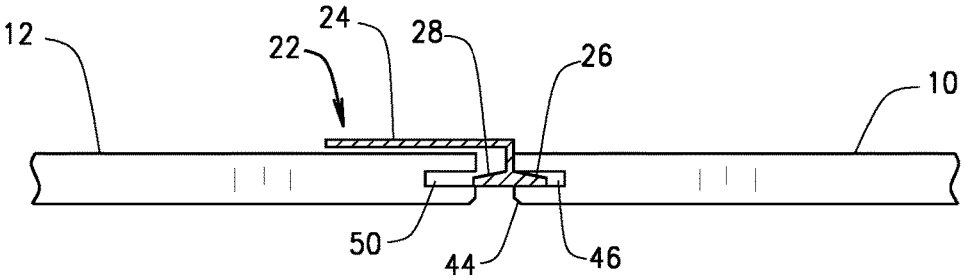
FIG. 3 is a cross-sectional view in side elevation of an embodiment of the spline joining system.

An edge 44 of panel 10 is provided with kerf 46 for receiving dog element 26 of spline connector 22 as shown in FIG. 3. Because the fiberglass reinforced resin core of the panel is homogeneous, it is relatively simple to rout out the kerf directly into the edge 44. The kerf side walls optimally are flat. The tapered end of dog element 26 enables its ready insertion into kerf 46. The inner width dimension of kerf 46 is equal to or less than the thickest portion of the wedge shape of dog element 26 so that the panel 10 can be snugly pushed and held firmly on to dog element 26. The depth of the kerf must be greater than the lateral length of dog element 26 so that the panel may fully seat on the spline connector. In similar fashion, panel 12 is provided with kerf 50 for receiving dog element 28 of spline connector 22. FIG. 3 shows panel 10 inserted on to dog element 26 of the spline with panel 12 being prepared for insertion on to dog element 28. As seen in FIG. 4, the distal flat surface 40 of spline connector 22 keeps the outer surface 52 of panel 10 evenly aligned with outer surface 54 of panel 12 as panel 12 is pushed into seating engagement on to dog element 28. The flat side walls of the kerfs maintain even alignment with flat surface 40 to ensure alignment of the external surfaces of the adjoining panels. Accordingly, the external surfaces of panels 10 and 12 are urged into planar alignment as the respective kerfs of the panels are moved along the angled surfaces of the dog elements while the distal flat surface maintain planar alignment of the joined panels.

Figure 6:
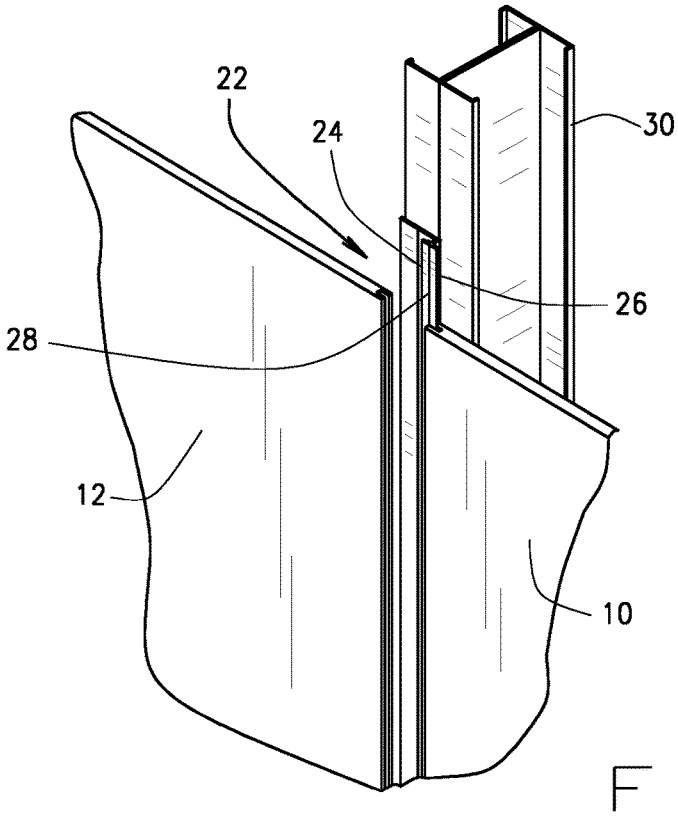
FIG. 6 is a perspective view of a first panel section being joined with a second panel section with an embodiment of the spline joining system.
Figure 9:
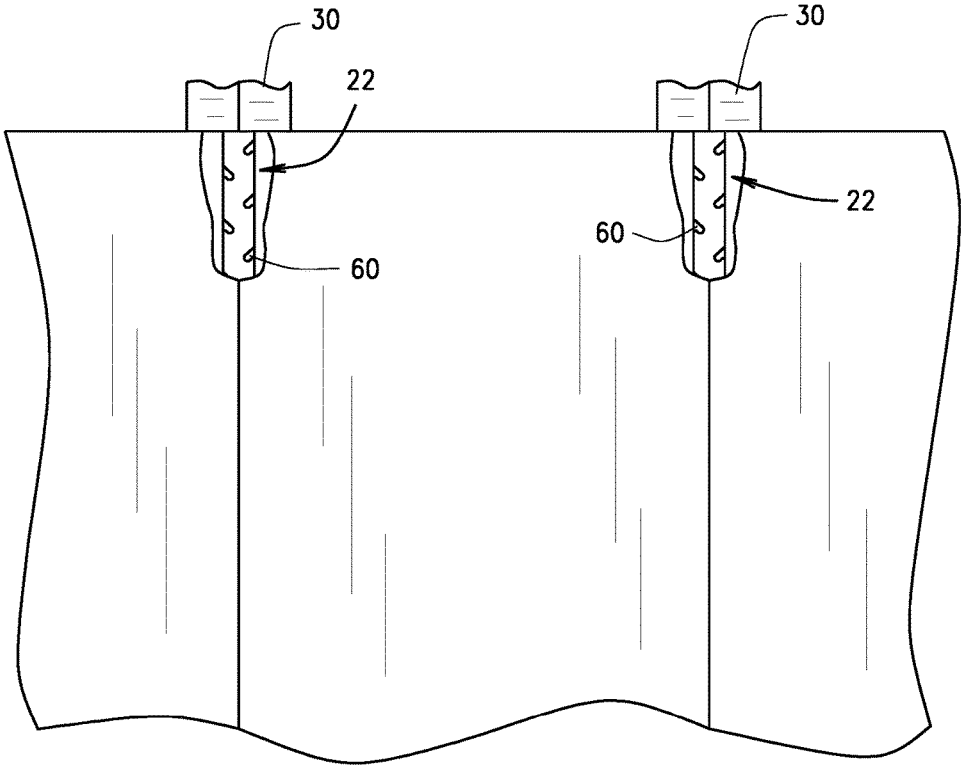
FIG. 9 is a perspective view of joined wall panels using an embodiment of the spline element.

The panels can be provided with kerfs on both lateral edges so that multiple panels in succession may be joined with the spline system as shown in FIG. 9. In this method, successive panels are installed in a progressive row along a wall or other surface substrate. With the first panel 10 of the row of panels to be installed on the surface substrate, the spline connector 22 is attached to panel 10 by inserting dog element 26 into kerf 46. After spline connector 22 is attached to panel 10, elongated leg 24 of spline element 22 is secured to stud 30 of the surface substrate. Once spline connector 22 and panel 10 are secured to stud 30, dog element 28 is in position to receive panel 12 as shown in FIG. 3 and FIG. 6. Dog element 28 is received in kerf 50 of panel 12. The flat surface 40 of spline element 22 guides the exterior surfaces 52 and 54 of panels 10 and 12, respectively, into exact even planar alignment as panels 10 and 12 are pushed together onto dog elements 26 and 28 as shown in FIG. 4. The joint seam between panels 10 and 12 are preferably sealed with appropriate compounds to ensure against air, moisture and gas leakage.

The opposite edge of installed panel 12, which has its other edge joined to panel 10 and secured to stud 30, is similarly configured with a kerf for receiving the dog element of another spline element. After the dog element is inserted into the kerf of the opposite edge of panel 12, elongated leg 24 of the spline element is secured to the next stud in line along the wall. Once so secured, dog element 28 is in position to be received in the kerf of the edge of the next available panel. This process is repeated as necessary to install panels along a given section of wall as shown in FIG. 9.

The system is readily adaptable to accommodate the placement of the panel joint system around obstructions or to custom fit into irregular shapes. The homogenous fiberglass reinforced resin core may be cut into an appropriate size on the job site and the kerfs can be cut into the edges using a router. Likewise, the spline connector may be cut to a certain length to fit the particular size panel. If necessary, the spline connector may extend only a partial distance along the joint line and the remaining gap filled with an appropriate joint-sealing compound.

An embodiment of spline connector 22 as shown in FIG. 2 comprises elongated leg 24 being 1.404 inches long to sufficiently engage stud 30 or other appropriate base substrate on the wall or ceiling to which the panels are affixed. The spline element extends 0.10 inches perpendicularly from elongated leg 24 to terminate in dog elements 26 and 28. Each of dog elements 26 and 28 extend laterally 0.252 inches from the spline element axis. The distal end of each of dog elements 26 and 28 is 0.06 inches thick tapering upwards to a thickness of 0.10 inches at their proximal end to present an upper wedge shaped surface 42. These dimensions are merely representative and different dimensions may be employed as would be understood by a person having skill in the art.

Figure 7:
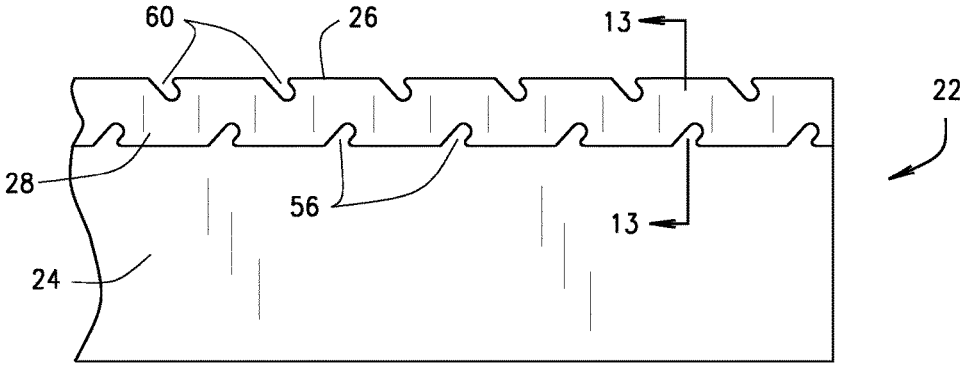
FIG. 7 is a top plan view of the spline element shown in FIG. 2 taken along lines 7-7.
Figure 13:
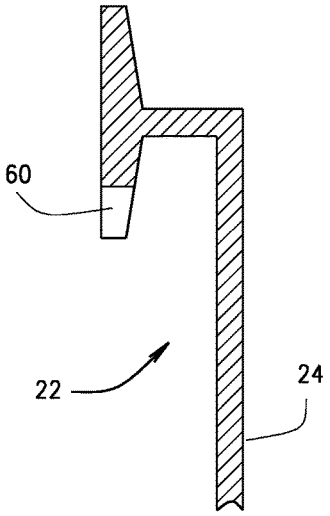
FIG. 13 is a cross-sectional view of the spline element shown in FIG. 7 taken along lines 13-13.
Figure 15:
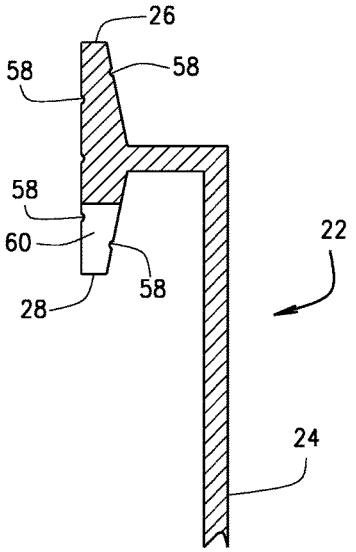
FIG. 15 is a cross-sectional view of the spline element shown in FIG. 14 taken along lines 15-15.
Figure 14:
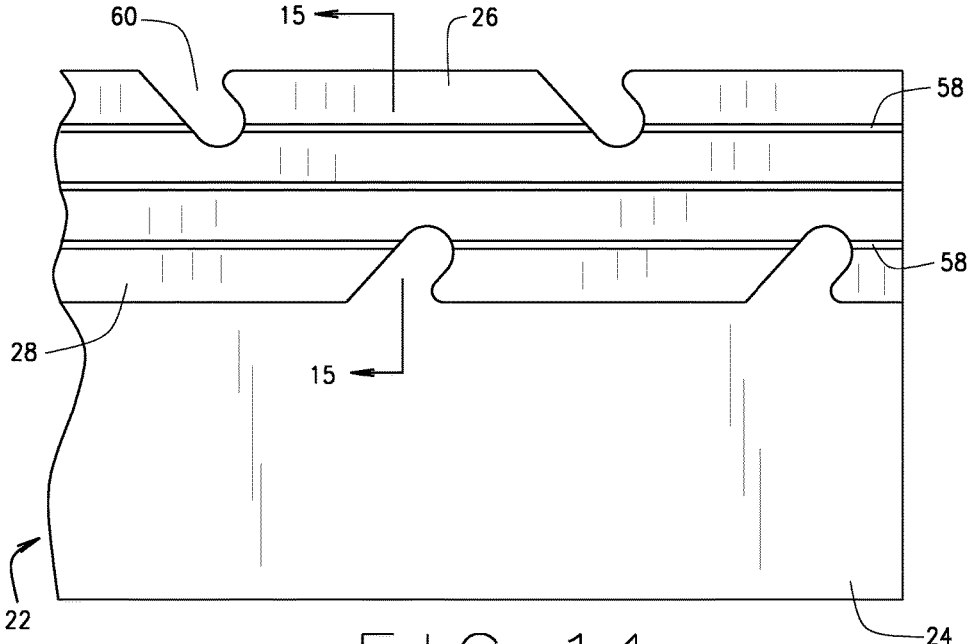
FIG. 14 is a top plan view of another embodiment of the spline element.

A further embodiment of the spline connector comprises modifying the spline to incorporate a series of channels 60 along dog elements 26 and 28 as shown in FIG. 7. The channels are disposed transversely to a longitudinal aspect of the spline. That is, the channels run in a direction transverse to the longitudinal length of the spline as shown in FIG. 8. Optimally, channels 60 are oriented 45 degrees from the spline axis and spaced at intervals of one inch or so along the length of the spline. Preferably, the channels pass through both surfaces 42 and 40 of the dog elements. FIG. 13 is a cross-sectional view of the spline connector shown in FIG. 7 which provides for a staggered arrangement of the channels along the length of the spline. The staggered arrangement preserves the structural integrity of the spline to lessen the chance for breakage. The channels may have rounded corners 56 at the edges of the flanges so as not to present a significant chance for injury during handling. Spline connector 22 may be provided with longitudinal grooves 58 placed on the exterior surfaces of dog elements 26 and 28 as shown in FIGS. 14 and 15. Grooves 58 may be placed on either, or both, surface sides of each dog element.

Figure 10:
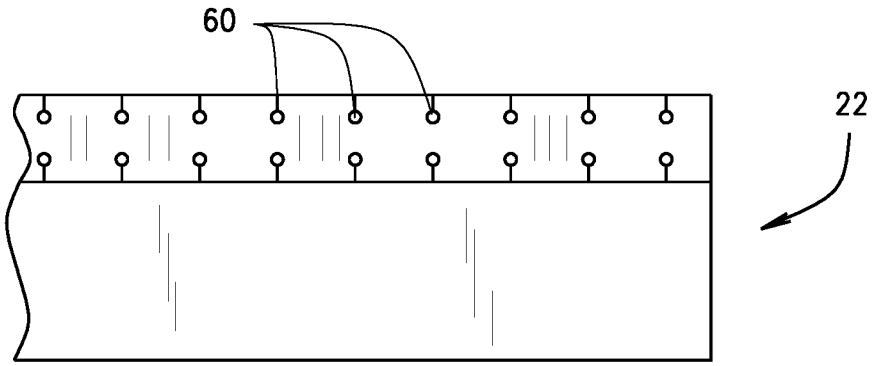
FIG. 10 is a top plan view of another embodiment of the spline element.
Figure 11:
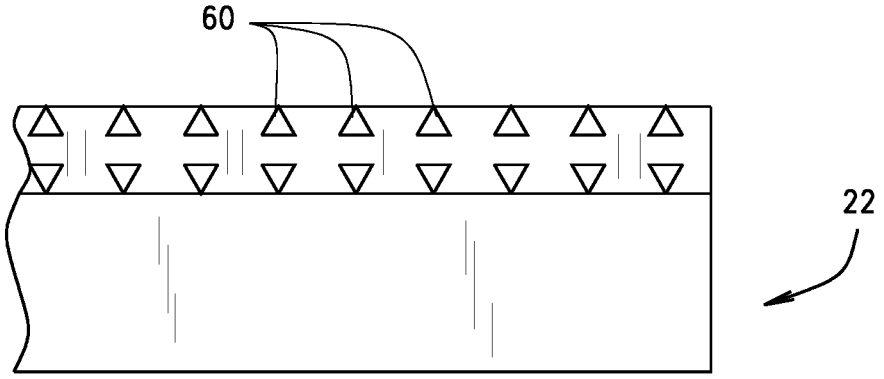
FIG. 11 is a top plan view of another embodiment of the spline element.
Figure 12:
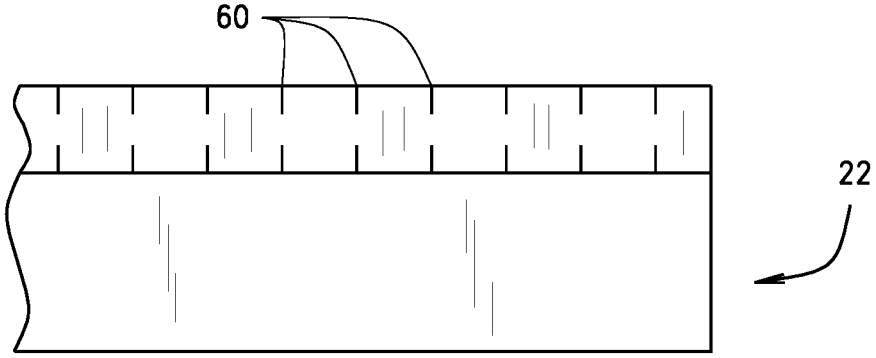
FIG. 12 is a top plan view of another embodiment of the spline element.

Prior to insertion of the spline into the kerf of a panel to be joined, sealant is placed in the kerf. An appropriate sealing agent as known to a person having skill in the art can be used and is referred to generally as sealant or compound. Upon insertion of the spline into the panel kerf, the sealant spreads around the dog element. Channels 60 permit the sealant to flow into and around the dog elements, providing a greater surface area for bonding of the spline to the panel kerf. Channels 60 should be configured in the dog elements so that they lie within the kerf of the panel edge, and to avoid extending into the center of the spline such that they may fall into the gap between joined panel members. Otherwise, the channels may contribute to blistering of the sealing compound in the seam between the joined edges of the panels. FIGS. 10-12 show alternate channel designs that may be configured into the dog elements by which the sealant may be distributed between the dog elements of the spline and the panel kerf. These designs are presented in views similar to that for the design shown in FIG. 7.

As the adhesive/sealant cures in the narrow channel grooves, certain advantages occur. The adhesive/sealant that infiltrates the channel grooves solidifies and welds to each wall cavity of the spline section, increasing the surface contact from the bottom to the top lip of the panel kerf edge for an interlock design. The narrow channel groove positioned at a 45 degree angle enables the flow of the adhesive/sealant freely. Once the adhesive/sealant has cured and solidified in place, the panel/spline assembly then becomes substantially resistant to lateral shear, essentially becoming an extremely strong adhesive zipper. The channel groove filled with the adhesive/sealant substantially welds the top and bottom lip of the panel edge joining them together to create a stitching effect in the panel groove thereby substantially increasing the panel and joint assembly strength.

What is claimed is:

1. A spline connector for joining adjacent panel members comprising a high containment enclosure, the panel members defining grooved edges for receiving the spline connector, the spline connector having a dimension to permit insertion in the grooved edges of the panel members, the spline connector comprising a substantially elongated member having lateral flanges extending from both sides of the elongated member for insertion in the grooved edges of the panel members, whereby the lateral flanges of both sides of the elongated member are adapted to engage the respective grooves of adjacently placed panel members, each lateral flange defining a wedge shape comprising a first surface lying in a plane parallel to a longitudinal aspect of the spline connector, and a second surface lying in a plane transverse to the plane of the first surface, the spline connector being adapted to maintain a snug and firm engagement within the grooved edge of the panel member, the spline connector defining a plurality of channels adapted to receive a sealing agent, the plurality of channels extending in a 45° angle with respect to a longitudinal aspect of the spline connector, the channels passing through the first and second surfaces of the lateral flanges, each channel further defining an opening within a side edge of the lateral flange, the channels being disposed in a staggered arrangement along the lateral flanges along both sides of the elongated member, such that the channels along the lateral flanges on a first side of the elongated member are staggered with respect to the channels along the lateral flanges on a second side of the elongated member, each of the channels on the first side of the elongated member being parallel to each other and each of the channels on the second side of the elongated member being parallel to each other.

2. The spline connector of claim 1 in which a plurality of grooves are disposed longitudinally along the length of the spline connector and are placed on at least one of the first and second surfaces of the lateral flanges.

3. A wall panel and spline joining system comprising a plurality of panel members and a plurality of spline connectors for constructing a high containment enclosure, each of the panel members having at least one grooved edge defining a kerf comprising flat sides, the spline connectors comprising substantially elongated members having lateral flanges extending from both sides of the elongated member adapted for insertion in the grooved edges of the panel members, whereby the lateral flanges of both sides of the elongated member are adapted to engage the respective grooves of adjacently placed panel members, each lateral flange defining a wedge shape comprising a first surface adapted to lie in parallel engagement with a first kerf side and a second surface lying in a plane transverse to a plane of the first surface, whereby the second surface of the flange is adapted to wedge against a second kerf side within the grooved edge of the panel member, the spline connector being adapted to maintain a snug and firm engagement within the grooved edge of the panel member, the spline connectors defining a plurality of channels adapted to receive a sealing agent, the plurality of channels extending in a 45° angle with respect to a longitudinal aspect of the spline connector, the channels passing through the first and second surfaces of the lateral flanges, each channel further defining an opening within a side edge of the lateral flange, the spline connectors having an engagement member for connecting joined wall panels to a substrate surface along a wall, the channels being disposed in a staggered arrangement along the lateral flanges along both sides of the elongated member, such that the channels along the lateral flanges on a first side of the elongated member are staggered with respect to the channels along the lateral flanges on a second side of the elongated member, each of the channels on the first side of the elongated member being parallel to each other and each of the channels on the second side of the elongated member being parallel to each other.

4. The wall panel and spline joining system of claim 3 in which a plurality of grooves are disposed longitudinally along the length of the spline connector and are placed on at least one of the first and second surfaces of the lateral flanges.

5. A method for joining panels in erecting a high containment enclosure, the method comprising: preparing panels comprised of a homogeneous fiberglass reinforced resin core, providing spline connectors, each spline connector comprising a leg portion adapted for securing to a substrate surface and a pair of laterally opposing flange members spaced apart from the leg portion, and further constructing the spline connectors to define a plurality of channels within the flange members, the plurality of channels adapted to receive a sealing agent, the plurality of channels extending in a 45° angle with respect to a longitudinal aspect of the spline connector, each of the channels on a first side of the elongated member being parallel to each other and each of the channels on a second side of the elongated member being parallel to each other, each panel having a kerf disposed in a side edge thereof, the kerf being formed directly into the homogeneous fiberglass reinforced resin core, each flange member of the spline connector adapted to engage the side edge of a panel by insertion into the kerf, each flange member defining a wedge shape comprising a first surface lying in a plane parallel to a longitudinal aspect of the spline connector, and a second surface lying in a plane transverse to the plane of the first surface, the channels passing through the first and second surfaces of the flange members, each channel further defining an opening within a side edge of the lateral flange, a pair of panels being joined together onto a substrate surface by first fastening the leg portion of a spline connector to a substrate surface, connecting a first panel to the spline connector by engaging a first flange member with the kerf in the edge of the first panel, then connecting a second panel to the spline connector adjacently and opposed to the first panel by engaging the opposing second flange member of the spline connector with the kerf in the second panel, the external surfaces of the first and second panels being urged into planar alignment as the respective kerfs of the panels are moved along the transverse second surface of the flange members while the first surface of the flange members maintain planar alignment of the joined panels, and applying a sealing agent into the kerfs of the respectively joined panels, whereby the channels in the flange members permit flow of the sealing agent through interstitial areas between the flange members and the kerf sides to promote thorough bonding of the spline connectors within the side edges of the panels.

6. The method of joining panels of claim 5 in which the spline connectors are constructed such that the channels are disposed in a staggered arrangement along the flange members such that the channels along a first lateral flange are staggered with respect to the channels along the opposing lateral flange.

7. The method of joining panels of claim 5 in which the spline connectors are constructed such that a plurality of grooves are placed longitudinally along the length of the spline connector and are placed on at least one of the first and second surfaces of the flange members.

* * * * *